US005213847A

United States Patent [19]

Hajek

[11] Patent Number: 5,213,847

[45] Date of Patent: May 25, 1993

[54] ELECTROSTATIC FLUIDIZED BED HAVING HORIZONTAL AND VERTICAL COATING EFFECTS AND METHOD UTILIZING SAME

[75] Inventor: Bedrich Hajek, Clinton, Conn.

[73] Assignee: Electrostatic Technology, Inc., Branford, Conn.

[21] Appl. No.: 712,575

[22] Filed: Jun. 10, 1991

[51] Int. Cl.[5] ..... B05D 1/24; B05B 5/053; B05B 5/057

[52] U.S. Cl. ..... 427/460; 118/634; 118/DIG. 5; 427/461

[58] Field of Search ..... 118/634, DIG. 5, 629; 427/185, 459–461

[56] References Cited

U.S. PATENT DOCUMENTS

| | | | |
|---|---|---|---|
| Re. 22,419 | 1/1944 | Smyser | 427/25 |
| 2,706,963 | 4/1955 | Hug | 118/51 |
| 3,019,126 | 1/1962 | Bartholomew | 117/17 |
| 3,828,729 | 8/1974 | Goodridge | 118/634 |
| 3,916,826 | 11/1975 | Knudsen | 118/629 |
| 4,030,446 | 6/1977 | Karr | 118/654 |
| 4,808,432 | 2/1989 | Hajek | 427/32 |

*Primary Examiner*—Evan Lawrence
*Attorney, Agent, or Firm*—Ira S. Dorman

[57] ABSTRACT

Electrostatic fluidized bed coating apparatus consists of an horizontal porous plate and a contiguous, vertical porous plate. Charged particles exiting the bed formed on the horizontal plate fall past the outer surface of the vertical plate, and are electrostatically recharged by ionized air issuing through it, thereby effectively extending the operative vertical length of the bed and substantially increasing coating efficiency.

20 Claims, 1 Drawing Sheet

ELECTROSTATIC FLUIDIZED BED HAVING HORIZONTAL AND VERTICAL COATING EFFECTS AND METHOD UTILIZING SAME

BACKGROUND OF THE INVENTION

A technique that is extensively used for producing coatings upon a wide variety of substrates entails the exposure of the workpiece (normally grounded) to a cloud of electrostatically charged particles, thus producing a deposit that can subsequently be integrated. Although there is now a substantial body of prior art, fluidized bed apparatus that is especially effective for use in such applications is disclosed in Goodridge U.S. Pat. No. 3,828,729, issued Aug. 13, 1974, Knudsen U.S. Pat. No. 3,916,826, issued Nov. 4, 1975, and Karr U.S. Pat. No. 4,030,446, issued Jun. 21, 1977. In Hajek U.S. Pat. No. 4,848,432, issued Feb. 28, 1989, an electrostatic powder coating unit is provided in which a tubular cloud of charged particles is induced to move helically within a cylindrical porous member, to coat workpieces conveyed through it.

Systems of the kind described have been employed with the workpieces moving in a variety of different ways; most commonly, however, the workpiece will be conveyed past the coating unit along either a horizontal or a vertical path. Illustrative vertical systems are disclosed in Smyser U.S. Pat. No. 22,419, issued Jan. 11, 1944, and Hug U.S. Pat. No. 2,706,963, issued Apr. 26, 1955 (note FIG. 3). Furthermore, both horizontal and vertical electrostatic fluidized bed coating systems are commercially available.

Despite the notable advances that have occurred in the art, as indicated by the foregoing, increased coating efficiencies and enhanced performance are normally considered to be highly desirable achievements. Accordingly, it is the broad object of the present invention to provide a novel apparatus, system and method for effecting the coating of a workpiece from an electrostatic fluidized bed, by which are afforded substantially increased levels of efficiency of deposition of the particulate material, and improved performance.

A more specific object of the invention is to provide such apparatus which is especially suited for operation in a vertical mode, and to provide such a system and method in which the workpiece is transported along a vertical path during coating.

Other specific objects are to provide an apparatus, system and method having the foregoing features and advantages, which are particularly well adapted for coating of continuous length, web-like substrates.

Further objects of the invention are to provide such an apparatus and system which are of relatively incomplex and inexpensive design and construction, and to provide such a method which is facile and convenient to carry out.

SUMMARY OF THE INVENTION

It has now been found that certain of the foregoing and related objects of the invention are attained by the provision of electrostatic coating apparatus comprising: a coating unit having at least one plenum therewithin, means for introducing air into the plenum, and means (normally contained in the plenum) for ionizing such introduced air. The coating unit comprises porous top wall and sidewall portions partially defining the plenum and constructed with the sidewall portion extending downwardly, and generally perpendicularly, relative to the top wall portion. Particles of a particulate coating material are electrostatically charged, therefore, during passage over the outer surfaces of both the top wall portion and the sidewall portion, by contact with ionized air issuing from the plenum therethrough.

Generally, the porous wall portions will be contiguous to one another, and the outer surfaces of both will normally be planar. And with the coating unit in its operating position, the surface of the top wall portion will usually be substantially horizontally oriented, and the sidewall portion will usually be substantially vertical.

In preferred embodiments the apparatus will include elements surrounding the top wall portion of the coating unit and extending upwardly therebeyond, so as to form therewith an open receptacle for the containment of a bed of the particulate coating material. At least one of such surrounding elements will constitute a low wall element interposed between the porous wall portions, and will be so dimensioned and configured as to permit the coating material to flow thereover in passing from the top wall portion to the sidewall portion; the wall element will normally have a rectilinear top edge, disposed in a horizontal plane.

Other objects of the invention are attained by the provision of a system that comprises, in association with the apparatus herein described, a housing defining a generally vertical travel path along which the workpiece will be transported for coating. Generally, the system will additionally include feed means for supplying particulate coating material to the outer surface of the top wall portion of the coating unit, as well as means for transporting the workpiece. In certain embodiments the system will incorporate a second such coating unit, with one of the coating units being disposed to opposite sides of the travel path through the housing.

Further objects of the invention are attained by the provision of a coating method, effected using the apparatus described. In carrying out the method, a quantity of an electrostatically chargeable particulate coating material is supplied to the outer surface of the top wall portion of the coating unit, and a portion thereof is caused to pass therefrom along an outer surface of the sidewall portion. Air is ionized and introduced into the plenum (not necessarily in that order), and is caused to issue therefrom through both the top wall portion and also the sidewall portion of the coating unit, to thereby effect electrostatic charging of the particles. The particles are attracted to and deposited upon the workpiece, which is maintained at an electrical potential that is effectively opposite to the charge thereon and is transported along a generally vertical travel path adjacent the sidewall portion of the coating unit. In the preferred embodiments the workpiece will be a continuous length web of material and the coating apparatus will include a second coating unit, the latter being so disposed as to enable the concurrent production of deposits on both faces of the web.

DETAILED DESCRIPTION OF THE PREFERRED AND ILLUSTRATED EMBODIMENT

Figure 1:
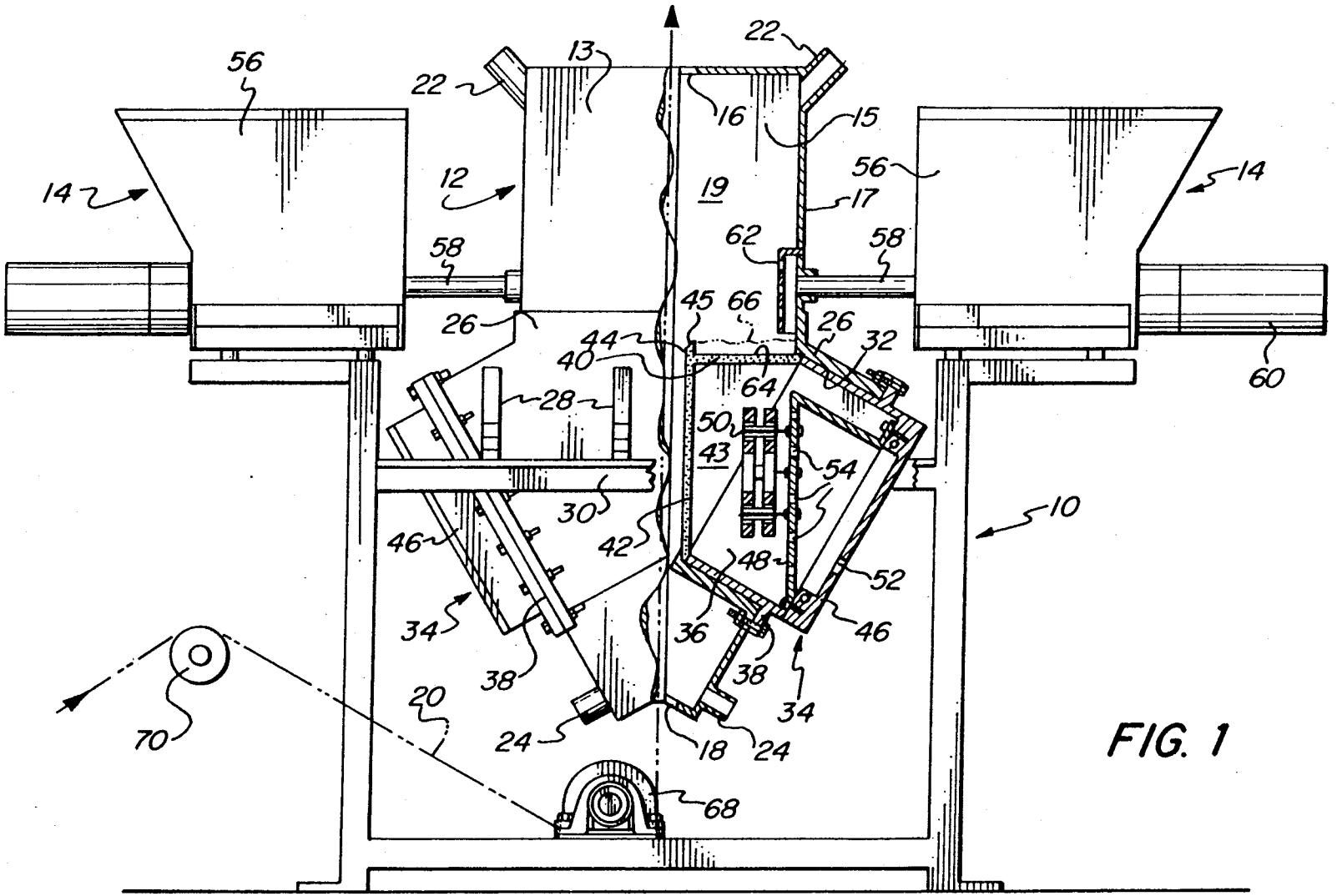
FIG. 1 is an elevational view illustrating the apparatus and system of the invention, portions of which are broken away to expose internal features.

Turning now in detail to the appended drawing, therein illustrated is a system and apparatus embodying the present invention. The system includes a stand, generally designated by the numeral 10, on which is supported a housing, generally designated by the numeral 12, and a pair of identical powder collection and feed assemblies, each generally designated by the numeral 14. The housing 12 is comprised of a front wall 13, a back wall 15, and opposite sidewalls 17, and it has entrance and exit slots 16 and 18 at the top and bottom, respectively, permitting transport therethrough of a continuous length, web-like substrate 20 (shown in phantom line). It will be appreciated that the housing 12 is of generally rectangular cross section (taken in a horizontal plane), and that it defines a double-effect coating chamber 19, the separate effects being afforded by means that are symmetrically disposed to opposite sides of the substrate travel path. Thus, a withdrawal port 22 is provided on each side of the housing at the top, for removal of air-entrained powder, and a similar port 24 is provided at the bottom of the housing, on each side, for removing powder that collects in the lower parts of the chamber 19. Vacuum and mechanical means will typically be used for effecting such withdrawals, as will be evident to those skilled in the art.

The midsection 26 of the housing 12 is of heavier construction than are the other portions, and lugs 28 project from the front and back panels; they rest upon the crosspiece 30 of the stand 10, and provide stable support for the housing. Large openings 32, of rectangular cross section, are defined within the midsection 26 on both sides of the housing 12, and each serves to receive and mount an electrostatic fluidized bed coating unit, generally designated by the numeral 34; since the coating units are identical, only one is described in detail.

The unit 34 consists, more particularly, of a rectangular base wall 36 (conforming to the corresponding opening 32), adjacent the outer end of which extends a surrounding flange portion 38 for bolting it in place. A planar, generally rectangular porous top plate or top wall portion 40 extends horizontally from the base wall 36. A like porous plate or sidewall portion 42 extends downwardly from along the inner edge of the plate 40 (i.e., in a vertical plane), and a low upstanding wall element or dam 44, having a rectilinear, horizontal upper edge 45, projects beyond the upper surface of the top plate 40 and defines an open shallow recess 64 in cooperation therewith and with the front and back panels 13, 15 of the housing 12. The porous top wall portion 40 and sidewall portion 42 cooperate to partially define a plenum 43.

The outer end of the base wall 36 of the coating unit 34 is closed by an end member 46, on the bracket 48 of which is in turn mounted charging electrode structure 50. An orifice 52 is formed through the transverse wall of the end member 46, and several apertures 54 extend through the mounting bracket 48. These features permit the introduction of air into the space beneath the bracket 48, and its direction into contact with the charging structure 50. The latter may advantageously take the form of the brush-like electrodes described in the above-identified Karr patent, as may the general arrangement of the air-flow controlling features.

Each of the two feed assemblies consists of a hopper 56, a delivery tube 58, a drive motor 60, and an open-ended distribution box 62 mounted on the sidewall 17 within the housing chamber 19. The motor 60 rotates a feed screw (not shown), disposed across the bottom of the hopper 56, to carry particulate coating material from the hopper through the delivery tube 58 and into the box 62, from which it falls into the underlying receptacle 64 to form a bed 66 thereof.

It will be understood that air under pressure, introduced through the orifice 52 (by means not shown) and flowing into contact with electrode structure 50 via the apertures 54, will be subjected to high voltage electrical energy applied to the electrode structure (also by means not shown), and thereby ionized. The ionized air issuing through the pores of plate 40 from the plenum 43 will serve to charge the particles of the bed 66, and to simultaneously effect fluidization thereof.

A substantial portion of the powder that exists in the receptacle 64 will be attracted to and will adhere on the exposed surfaces of substrate 20, which is maintained (again by means not shown) at an effectively opposite electrical potential for that purpose. The rest of the material that passes over the low wall element 44 will, of necessity, fall past the outer surface of the vertical plate 42, and be subjected to the ionized air that issues from the plenum 43 through the pores of plate 42. This promotes a further build of material upon the substrate surface (probably through a recharging mechanism) and produces a significant enhancement of coating efficiency, thereby effectively extending the vertical length of the bed.

Means for transporting the workpiece 20 are suggested by the motor 68, mounted upon the lower portion of the frame 10, and the pulley 70. Additional transport components will of course be present in a working installation, the particular nature and details of which will be readily apparent to those skilled in the art.

Although not illustrated, the system and apparatus of the invention will generally include other conventional features, as well. For example, level control sensors will normally be associated with the fluidized beds, for actuating the feed mechanisms in order to satisfy sensed deficiencies in the supply of powder. Appropriate vacuum, pneumatic, and electrical equipment will also be incorporated, along with the control means necessary to establish and maintain suitable operating conditions. It might be mentioned in this connection that best results will often be produced by so controlling the flow rate of air through the porous top plate 40 as to not only fluidize the bed 66 of coating material, but indeed to promote a gentle flow of powder (independent of the effects of electrostatic attraction) over the interposed wall element 44.

Other conditions of operation, such as suitable voltages to be applied, workpiece throughput rates, and the like, will be evident to those skilled in the art. It should be appreciated however that the spacing of the workpiece from the vertical porous plate(s) will have a significant effect upon coating efficiency, due not only to principles of electrostatic attraction and charge dissipation but also to physical factors, such as the size of the gap through which the undeposited powder will fall. Materials of construction will be self evident, and are in any event aptly taught in the above-cited prior art patents.

The illustrated system and apparatus exemplify the best mode presently contemplated for carrying out the invention, but are not of course to be taken in a limiting sense. For example, the coating unit and its associated chamber may be of any suitable configuration and construction, as may be the porous plate and its design. Moreover, although only one vertically oriented porous plate is shown on the coating unit, it will be appreciated that a plural-sided bed may be preferred in certain circumstances.

Finally, it will be appreciated that a considerable diversity of workpieces may be employed in the practice of the invention, including not only wires, fibrous bundles, and the like, but also discrete objects. As has been emphasized hereinabove, however, greatest benefit will often be realized in the coating of continuous length, web-like substrates, such as woven and non-woven fabrics, which may in turn be utilized to produce composite webs by fusion of the particulate coating material and encapsulation of the fibers therewith.

Thus, it can be seen that the present invention provides a novel apparatus, system, and method for effecting the coating of a workpiece from an electrostatic fluidized bed, by which are afforded substantially increased levels of efficiency. The apparatus is especially suited for operation in a vertical mode, and the system and method are correspondingly adapted for use in connection with a workpiece that is transported along a vertical path during coating. The instant apparatus and system are of relatively incomplex and inexpensive design and construction, and the method is facile and convenient to carry out.

Having thus described the invention, what is claimed is:

1. Electrostatic coating apparatus, comprising:

at least one coating unit, said one coating unit having at least one plenum therewithin and comprising a porous top wall portion and a porous sidewall portion extending downwardly and generally perpendicularly relative to said top wall portion, said sidewall and top wall portions partially defining said one plenum, and having outer surfaces in communication with said one plenum through the pores thereof; means for introducing air into said one plenum; and means for ionizing such introduced air; whereby particles of a particulate coating material can be electrostatically charged during passage over said outer surfaces of both said top wall portion and said sidewall portion, by contact with air from said one plenum issuing from said wall portions in ionized condition.

2. The apparatus of claim 1 wherein said top wall portion and said sidewall portion of said one coating unit are contiguous.

3. The apparatus of claim 2 wherein said outer surface of said top wall portion is planar, and is substantially horizontally oriented with said one coating unit in a normal operating position.

4. The apparatus of claim 3 wherein said outer surface of said sidewall portion is planar, and is substantially vertically oriented with said one coating unit in a normal operating position.

5. The apparatus of claim 1 wherein said apparatus further includes elements surrounding said top wall portion and extending upwardly therebeyond so as to form therewith an open receptacle for the containment of a supply of a particulate coating material, one of said elements constituting a low wall element interposed between said wall portions, said wall element being dimensioned and configured to permit the coating material to flow thereover in passing from said outer surface of said top wall portion to said outer surface of said sidewall portion.

6. The apparatus of claim 1 wherein said means for ionizing is disposed in said one plenum.

7. An electrostatic coating system, comprising:

a housing defining a generally vertical travel path portion therethrough along which a workpiece may be transported for coating within said housing; and coating apparatus associated with said housing, said coating apparatus comprising:

at least one coating unit, said one coating unit having at least one plenum therewithin and comprising a porous top wall portion and a porous sidewall portion extending downwardly and generally perpendicularly relative to said top wall portion, and along said travel path, said sidewall and top wall portions partially defining said one plenum, and having outer surfaces in communication with said one plenum through the pores thereof; means for introducing air into said one plenum; and means for ionizing such introduced air;

whereby particles of a particulate coating material can be electrostatically charged during passage over said outer surfaces of both said top wall portion and said sidewall portion of said apparatus by contact with air from said one plenum issuing from said wall portions thereof in ionized condition, and whereby a workpiece can be coated with the charged particles during transport along said travel path portion.

8. The system of claim 7 wherein said top wall portion and said sidewall portion of said one coating unit are contiguous.

9. The system of claim 8 wherein said outer surface of said top wall portion is planar, and is substantially horizontally oriented.

10. The apparatus of claim 9 wherein said outer surface of said sidewall portion is planar, and is substantially vertically oriented.

11. The system of claim 7 wherein said system further includes elements surrounding said top wall portion of said one coating unit and extending upwardly therebeyond so as to form with said top wall portion an open receptacle for the containment of a supply of a particulate material, one of said elements constituting a low wall element interposed between said wall portions, said wall element being dimensioned and configured to permit the coating material to flow thereover in passing from said outer surface of said top wall portion to said outer surface of said sidewall portion.

12. The system of claim 7 wherein said means for ionizing is disposed in said one plenum of said one coating unit.

13. The system of claim 7 further including feed means for supplying particulate coating material to said outer surface of said top wall portion of said one coating unit.

14. The system of claim 7 further including a second said coating unit, said one coating unit and said second coating unit being disposed to opposite sides of said travel path portion.

15. The system of claim 7 further including means for transporting a continuous length web material along said travel path portion.

16. A method for coating a workpiece with a particulate material, comprising the steps:

(a) providing electrostatic coating apparatus, said apparatus comprising: at least one coating unit, said one coating unit having at least one plenum therewithin and comprising a porous top wall portion and a porous sidewall portion extending downwardly and generally perpendicularly relative to said top wall portion, said sidewall and top wall portions partially defining said one plenum, and having outer surface in communication with said one plenum through the pores thereof; means for introducing air into said one plenum; and means for ionizing such introduced air, said one coating unit being so positioned as to orient said top wall portion generally horizontally and said sidewall portion generally vertically;

(b) supplying to said outer surface of said top wall portion of said one coating unit a quantity of particulate coating material, and causing a portion of said quantity of coating material to pass from said top wall portion along said outer surface of said sidewall portion, the particles of said coating material being capable of acquiring an electrostatic charge;

(c) introducing air into said one plenum, ionizing said air, and causing said ionized air to issue from both said top wall portion and said sidewall portion of said one coating unit, to thereby electrostatically charge said particles passing over and along said outer surfaces of said portions; and (d) transporting a workpiece along a generally vertical travel path portion past and adjacent said sidewall portion, said workpiece being maintained at an electrical potential that is effectively opposite to the charge on said charged particles, so as to electrostatically attract said charged particles and develop a deposit thereof upon said workpiece.

17. The method of claim 16 wherein said top wall portion and said sidewall portion of said one coating unit are contiguous, wherein said outer surfaces of both of said portions are planar, and wherein said apparatus includes elements surrounding said top wall portion and extending upwardly therebeyond so as to form therewith an open receptacle for the containment of a supply of said particulate coating material, one of said elements constituting a low wall element interposed between said wall portions, said coating material flowing over said wall element in passing from said outer surface of said top wall portion to said outer surface of said sidewall portion.

18. The method of claim 16 wherein said workpiece is transported upwardly along said travel path portion.

19. The method of claim 16 wherein said coating apparatus includes a second said coating unit, said one coating unit and said second coating unit being disposed to opposite sides of said travel path portion, and wherein said workpiece has two opposite faces, said steps (b) and (c) being carried out with respect to both of said coating units so as to develop a deposit on both of said opposite faces of said workpiece.

20. The method of claim 16 wherein said workpiece is a continuous length web of material.

* * * * *